United States Patent [19]

Fey

[11] Patent Number: 4,553,038

[45] Date of Patent: Nov. 12, 1985

[54] CENTRAL LOCKING INSTALLATION

[75] Inventor: Rainer Fey, Schweinfurt, Fed. Rep. of Germany

[73] Assignee: Fichtel & Sachs AG, Schweinfurt, Fed. Rep. of Germany

[21] Appl. No.: 583,935

[22] Filed: Feb. 27, 1984

[30] Foreign Application Priority Data

Apr. 22, 1983 [DE] Fed. Rep. of Germany ..... 3314573

[51] Int. Cl.[4] ..... H01H 47/22

[52] U.S. Cl. ..... 307/10 AT; 307/10 R; 361/152; 361/191

[58] Field of Search ..... 307/10 R, 10 AT, 113, 307/115; 361/31, 139, 160, 170, 187, 189, 192, 152, 191, 193, 156, 172; 340/63, 542, 543, 64; 70/262, 264, 271, 280; 186/287, 289

[56] References Cited

U.S. PATENT DOCUMENTS

| | | | |
|---|---|---|---|
| 4,424,548 | 1/1984 | Fey et al. | 361/156 X |
| 4,428,024 | 1/1984 | Mochida et al. | 307/10 AT |
| 4,466,044 | 8/1984 | Fey | 307/10 AT X |

FOREIGN PATENT DOCUMENTS

| | | |
|---|---|---|
| 2925177 | 1/1981 | Fed. Rep. of Germany . |
| 3030569 | 3/1982 | Fed. Rep. of Germany . |
| 1293123 | 10/1972 | United Kingdom . |

*Primary Examiner*—Harry E. Moose, Jr.

*Assistant Examiner*—Todd E. DeBoer

*Attorney, Agent, or Firm*—Toren, McGeady, Stanger, Goldberg & Kiel

[57] ABSTRACT

The central locking installation for motor vehicles comprises a plurality of electric bolt drives (1) and a time control system (17, 19) trippable by at least one manually actuatable control switch (21). In a first switch position of the control switch (21) the system switches on the bolt drives (1) for a first pre-determined time period in the locking direction and in a second switch position of the control switch (21) switches them on for a second pre-determined time period in the unlocking direction. For automatic overload prevention a capacitor (27) is provided which is charged through a charging current circuit (29, 31, 33) enabled by the time control system (17, 19) during the pre-determined first and/or second time period. A threshold stage (37, 41, 43, 45) which blocks the time control system (17, 19) on reaching of a pre-determined value of the capacitor voltage for the switching on of the bolt drives (1) in the locking and/or unlocking direction is connected to the capacitor. Furthermore a discharge current circuit (35) enabled at least when the bolt drives (1) are switched off is connected to the capacitor. The threshold stage (37, 41, 43, 45) preferably has a hysteresis property and enables the bolt drives (1) again at a value of the capacitor voltage which is less than that value of the capacitor voltage at which the bolt drives (1) are blocked.

5 Claims, 1 Drawing Figure

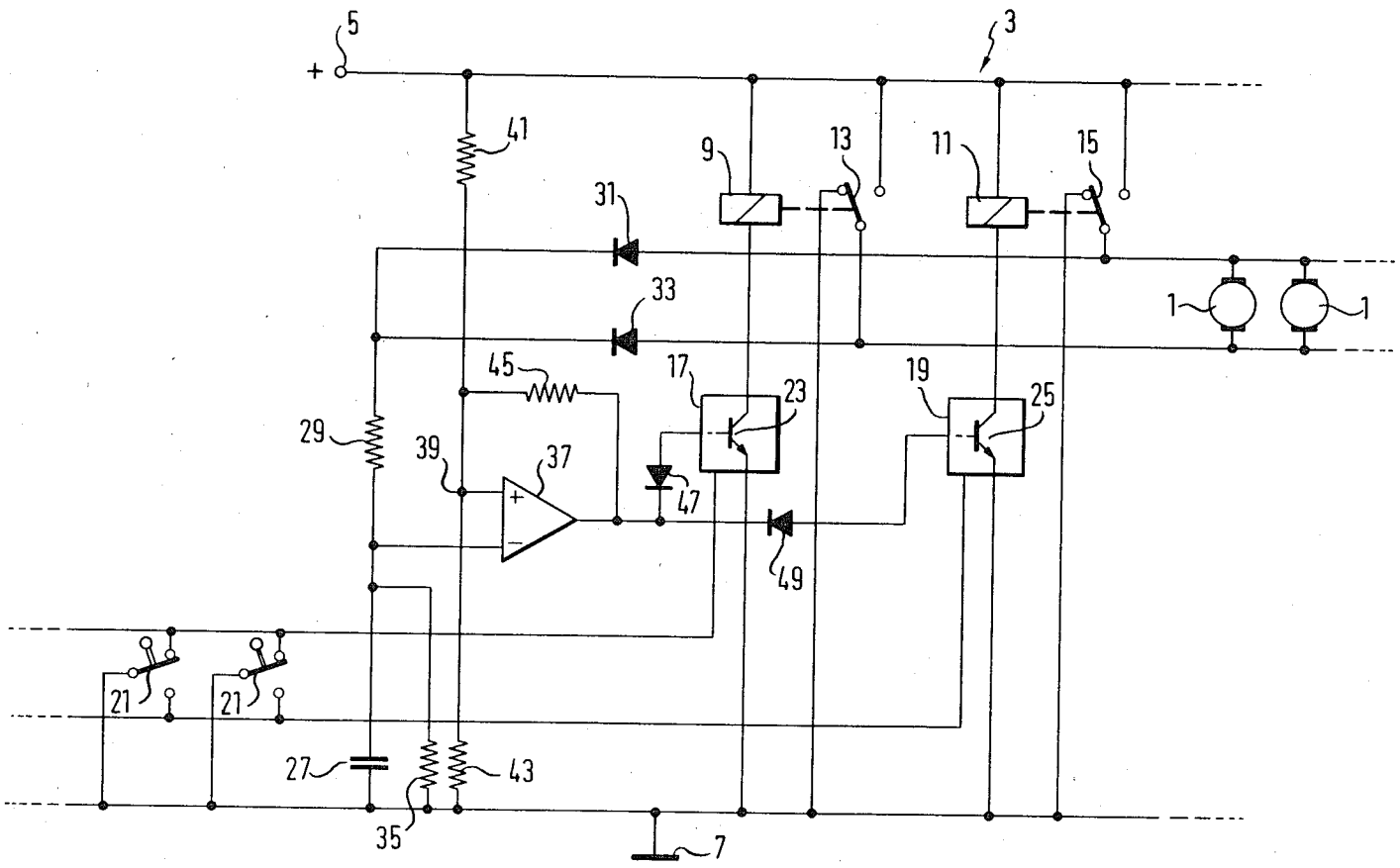
1
1
3
5
+
7
9
11
13
15
17
19
21
21
23
25
27
29
31
33
35
37
39
41
43
45
47
49

CENTRAL LOCKING INSTALLATION

BACKGROUND OF THE INVENTION

The invention relates to a central locking installation for motor vehicles having a plurality of electric bolt drives and having a time control system comprising at least one manually actuatable control switch, which system switches on the bolt drives in a first switch position of the control switch for a first pre-determined time period in the locking direction and in a second switch position of the control switch for a second pre-determined time period in the unlocking direction.

STATEMENT OF PRIOR ART

Such a central locking installation is known for example from German Publication Specification No. 30 30 569. The bolt drives drive the locking mechanisms of the door and bonnet locks of the motor vehicle. The drive direction is controlled by the switch position of a switch operative in the manual unlocking or locking of at least one of the door locks, for example the driver's door lock. To each of the drive directions a separate time control stage is allocated which on triggering by the control switch switches on the bolt drives for a pre-determined time period alternately in the locking and unlocking direction as appropriate.

The time period determined by the time control stage is dimensioned so that the locking mechanisms of the door, boot and bonnet locks of the motor vehicle will reliably be locked or unlocked. Since the switch-on duration is limited by the time control stages, the drive motors of the bolt drives are dimensioned only for a limited and uninterrupted working duration of one minute for example. If the switch-on duration is exceeded, for example by reason of a defect of the time control stage, this can lead to destruction of the windings of the drive motors.

It is further known to prevent overload damage in that a fuse resistor with a metal spring soldered joint is connected into a load current circuit. On loading-dependent heating of the metal spring by the fuse resistor the soldered connection is unsoldered and the circuit is interrupted. The replacement of the fuse resistor is expensive and time-consuming.

OBJECT OF THE INVENTION

It is an object of the invention to provide means by which the bolt drives of the central locking installation as initially explained can be automatically protected against overloading without need, after tripping of the overload fuse, for extensive repairs to be carried out to the central locking installation.

SUMMARY OF THE INVENTION

To overcome this problem, the invention provides a load current circuit connected to a capacitor. The time control system enables the load current circuit during a predetermined first and/or second time period. A threshold stage connected to the capacitor responds to the capacitor voltage. The threshold stage blocks the time control system and/or the bolt drives on reaching of a predetermined value of the capacitor voltage for the switching on of the bolt drives in the locking and/or unlocking direction. At least when the bolt drives are switched off by the time control system, a discharge current circuit is effective.

The capacitor is charged during the switch-on period of the bolt drives. The charging time constant is dimensioned so that the capacitor voltage reaches the voltage value fixed by the threshold stage within the permissible long-term operating time period of the bolt drives, at which value the time control system or possibly the bolt drives alone is or are blocked against further tripping. In the inoperative periods of the bolt drives a discharge circuit provides for the discharging of the capacitor. The discharge time constant is so dimensioned that the bolt drives can cool during the discharging of the capacitor to a temperature which is not critical for operation.

The capacitor is expediently connected through the charging current circuit in parallel to the bolt drives, which are likewise connected in parallel with one another. In so far as the bolt drives are connected to a polarity-changer circuit for the reversal of their direction of drive, diodes polarised in the forward direction for the charging current of the capacitor can be provided in series with the capacitor. The diodes ensure that the capacitor is charged in both drive directions. In some forms of embodiment, especially those where each of the bolt drives positively controls a control switch allocated to it and tripping the time control system, it is sufficient if the capacitor is charged only in one drive direction, since in the case of positively controlled change-over switches the drive direction can be reversed solely in the end positions of the bolt drives.

In especially simple forms of embodiment the discharge current circuit consists of a discharge resistor connected in parallel with the capacitor.

The threshold stage preferably has hysteresis properties in order to ensure that an adequate time period elapses for cooling between the blocking of the bolt drives and release. In a form of embodiment which is capable of functioning reliably even under the conditions of interference voltage and working temperature of the motor vehicle, the threshold stage comprises a comparator the non-inverting input of which is connected to a reference voltage source and through a feedback resistor with the output of the comparator and the inverting input of which is connected to the capacitor. The ratio of the values at which the time control system is blocked and released can be adjusted without problem by selection of the feedback resistor.

The threshold stage expediently blocks the time control system only in the unlocking direction, so that the vehicle can be locked securely even with commencing overloading of the bolt drives.

The term charging current circuit used above covers all circuit arrangements which render possible either the charging of an uncharged capacitor or the inverse charging of an already charged capacitor. Correspondingly the term discharge current circuit is to be understood to cover a current circuit which renders possible a current flux directed oppositely to the current direction of the charging current circuit. In so far as the threshold stage has hysteresis properties, by the lower value of the capacitor voltage enabling the time control system there should be understood such a value which is reached by the action of the discharge current circuit, starting from the greater threshold value which blocks the time control system.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

An example of embodiment of the invention is to be explained in greater detail below by reference to a drawing. The drawing shows a circuit diagram of a central locking installation for motor vehicles automatically securing against overload.

DESCRIPTION OF THE PREFERRED EMBODIMENT

For the drive of locking devices on the doors, boot lid or bonnet of a motor vehicle the central locking installation comprises bolt drives with direct-current motors 1 which are connected in parallel with one another through a polarity-changing circuit 3 between a positive voltage terminal 5 and ground 7. The ground 7 is connected with a negative voltage terminal. The polarity changing circuit 3 comprises two relays 9, 11 the movable change-over contacts 13 and 15 respectively of which are each connected to a terminal of the motors 1. The change-over contacts 13, 15 are connected to ground in their rest position, that is when the relay 9 or 11 is not energised. The relays 9 and 11 are energised alternately, the changeover contact 13 or 15 of the energised relay connecting the motors 1 with the positive voltage terminal 5. If the relay 9 is energised, the motors 1 are switched on in the unlocking direction. When the relay 11 is energised the motors 1 are switched on in the locking direction.

The energisation of the relays 9, 11 is controlled by time control stages 17, 19. The time control stages 17, 19 are triggered alternately in dependence upon the switch position of control change-over switches 21 and in each case supply a current pulse of pre-determined duration to the exciting windings of the associated relays 9 and 11 respectively. The current pulse switches over the change-over contact 13 or 15 out of the rest position as represented in the drawing in each case into the other position switching on the motors 1. The control change-over switches 21 are positively coupled with the bolt drives, so that the manual actuation of one of the control change-over switches, for example by manual locking of the driver's door lock, switches on the motors 1 of all bolt drives, whereby the other control change-over switches 21 are likewise switched over.

As overload safety device there is provided an electric integrator circuit which prevents the switching on of the motors 1, which are not designed for long-term operation, if the permissible long-term operation time is exceeded for example due to jamming of the drives or a defect in the time control stages 17, 19. Preferably in this case an output transistor 23 or 25 of the time control stages 17, 19 is blocked or released for the control action by the time control stage. The output transistor 23, 25 works in switch operation, its collector-emitter path being connected in series with the exciting winding of the relay 9 or 11.

The integrator circuit comprises a capacitor 27 which is connected on one side to ground 7 and on the other through a resistor 29 to the cathodes of two diodes 31 and 33. The anodes of the diodes 31, 33 are connected with the change-over contacts 13, 15. The diodes 31, 33 and the resistor 29 connected in series with the diodes form a charging current circuit through which the capacitor 27 is connected in parallel with the motors 1. The capacitor 27 is charged in both drive current directions as long as the motors 1 are switched on. A discharge resistor 35 is connected parallel to the capacitor 27.

The inverting input "−" of a comparator 37 is connected to the non-earthed terminal of the capacitor 27 and the non-inverting input "+" of the comparator 37 is connected with a connection point 39 of two resistors 41 and 43, which are connected in series with one another in a voltage-divider circuit between the voltage terminal 5 and ground 7. Furthermore a feedback resistor 45 is connected between the output of the comparator 37 and the connection point 39. In such a circuit the comparator 37 has a property of hysteresis since the feedback resistor 45, in dependence upon the output level of the comparator 37, varies the reference potential fixed by the resistors 41, 43 at the connection point 39. The amount of the hysteresis can be varied by suitable dimensioning of the feedback resistor 45. The output of the comparator 37 is connected through isolating diodes 47 and 49 with the time control stages 17 and 19 respectively. The isolating diodes 47, 49 are coupled through additional control transistors, for example to the bases of the output transistors 23, 25, in such a way that the transistors 23, 25 are blocked or opened in dependence upon the output level of the comparator 37.

The output level of the comparator 37 is determined by the voltage on the capacitor 27. The capacitor 27 is charged during the switch-on period of the motors 1, which is determined by the time control stages 17, 19. The charge time constant, determined by the resistor 29, is so dimensioned that the capacitor reaches a first reference voltage for example of $\frac{2}{3}$ of the operating voltage only after several load cycles. The first reference voltage is determined by the resistors 41, 43 and 45. If the capacitor voltage exceeds the first reference voltage, then the output level of the comparator 37 changes from a high output level to a low output level, for example ground potential, which blocks the output transistors 23, 25 of the time control stages 17, 19 through the diodes 47, 49. The potential on the connection point 39 is reduced through the feedback resistor 45 to a second, lower reference voltage level of for example $\frac{1}{3}$ of the operating voltage. The comparator 37 keeps the output transistors 23, 25 blocked until the capacitor 27 has discharged through the discharge resistor 35 to a voltage equal to the second reference voltage level. When the capacitor voltage reaches the second reference voltage level, the output level of the comparator 37 tips to the high output potential and enables the output transistors 23, 25 for control by the time control stages 17, 19.

The discharge time constant of the capacitor 27, determined by the discharge resistor 35, is greater than the charging time constant, so that the capacitor 27 may be charged despite the constant effectiveness of the discharge resistor 35. The discharge time constant is so dimensioned that an adequate cooling time of the motors 1 is guaranteed and the blocking time does not become unacceptably long for the user.

In the example of embodiment as represented in the drawing the capacitor 27 is charged in both drive current directions of the motors 1. Since the motors 1 positively control the switches 21 and thus continuous triggerung of the time control stages 17, 19 in a constant control direction is precluded, it may be possible to eliminate one of the two diodes 31 or 33.

Furthermore it can be advantageous if only the time control stage 17 which is effective in the unlocking direction, but not the time control stage 19 which is effective in the locking direction, is blocked. In this way it is ensured that the motor vehicle can be locked in every case.

While specific embodiments of the invention have been shown and described in detail to illustrate the application of the inventive principles, it will be understood that the invention may be embodied otherwise without departing from such principles.

What is claimed is:

1. Central locking installation for motor vehicles, comprising:

(a) a plurality of locking drives;

(b) at least one control switch manually switchable between one first switch position and one second switch position;

(c) a time control coupled to the control switch and to one locking drive, which in a first switch position of the control switch transmits a first drive signal to the locking drives, which drives said locking drives during a first predetermined time period in a locking direction and which in a second switch position of the control switch transmits a second drive signal to the locking drives, which drives said locking drives during a second predetermined time period in an unlocking direction;

(d) a condenser;

(e) a first circuit connected to the condenser and the time control for permitting a charging current to the condenser in a first current direction, as long as the time control transmits the first or the second drive signal;

(f) a second circuit connected to the condenser which enables a charging current to the condenser in a second current direction opposite to the first current direction, as long as the time control transmits none of the drive signals; and (g) a threshold value stage with hysteresis property connected to the condenser and the time control which responds to the condenser voltage and prevents at least the transmittal of the second of the two drive signals to the locking drive if the condenser voltage exceeds a first predetermined voltage value because of the charging current flowing in the first current direction and permits the transmittal of the drive signal if the condenser voltage reaches a second predetermined voltage value differing from the first value because of the charging current flowing in the second current direction.

2. Central locking installation according to claim 1, wherein the locking drives are arranged in parallel with each other and are connected to an operating voltage source through a current reversing circuit controllable by the time control and wherein the first current circuit comprises at least one diode coupling the condenser in shunt connection with the first or second drive signal to the locking drives, said diode being polarized in current transmitting with reference to the current direction of the drive signal.

3. Central locking installation according to claim 1, wherein the second current circuit is designed as a resistance connected in parallel with the condenser and wherein the time constant of the second current circuit is larger than that of the first current circuit.

4. Central locking installation according to claim 1, wherein the second voltage value amounts to a lower value than the first voltage value.

5. Central locking installation according to claim 4, wherein the threshold value stage comprises a comparator whose non-inverted input is connected with a reference voltage source and is connected with the output of the comparator through a feedback resistance and whose inverted input is connected with the condenser.

* * * * *